US007913701B2

(12) United States Patent
Dieudonat

(10) Patent No.: US 7,913,701 B2
(45) Date of Patent: Mar. 29, 2011

(54) MASCARA BRUSH

(75) Inventor: Fabrice Dieudonat, Fosses (FR)

(73) Assignee: Alcan Packaging Beauty Services (FR)

( * ) Notice: Subject to any disclaimer, the term of this patent is extended or adjusted under 35 U.S.C. 154(b) by 317 days.

(21) Appl. No.: 11/538,725

(22) Filed: Oct. 4, 2006

(65) Prior Publication Data

US 2008/0099034 A1 May 1, 2008

(51) Int. Cl.
*A45D 40/26* (2006.01)
*A46B 3/18* (2006.01)

(52) U.S. Cl. ..... 132/218; 15/206

(58) Field of Classification Search ..... 132/218, 132/320, 317; 15/206; 401/118, 129
See application file for complete search history.

(56) References Cited

U.S. PATENT DOCUMENTS

2008/0041407 A1* 2/2008 Kearney ..... 132/218

FOREIGN PATENT DOCUMENTS

| | | |
|---|---|---|
| DE | 308256 | 10/1918 |
| DE | 4205935 | 9/1993 |
| FR | 2155192 | 5/1973 |

OTHER PUBLICATIONS

FR 0406581 (FA 650681), Search Report, dated Feb. 1, 2005.

* cited by examiner

*Primary Examiner* — Rachel Running Steitz
(74) *Attorney, Agent, or Firm* — Banner & Witcoff, Ltd.

(57) ABSTRACT

A mascara brush comprises a core formed from a helical twist and a plurality of bristles fixed to the core over a portion extending over an axial length L of the helical twist and comprising a succession of n turns. The plurality of bristles comprises a first plurality of bristles termed radial bristles. The core has an upper portion for fixing to a wand of a mascara applicator. The brush is characterized in that the plurality of bristles further comprises at least one second plurality of bristles termed axial bristles since they extend parallel to the axial direction. The presence of axial bristles in the brush can broaden mascara formulation possibilities.

14 Claims, 7 Drawing Sheets

MASCARA BRUSH

FIELD OF THE INVENTION

The invention generally relates to the field of applicators for cosmetic products, typically mascara applicators, provided with a brush.

BACKGROUND OF THE RELATED ART

A number of mascara applicators are known. The applicators, which are intended to cooperate with a receptacle forming a reservoir for the mascara, typically comprise: a cap for closing the receptacle and acting as a means for gripping the applicator; an axial wand; and a brush; the wand being fixed to the cap at one of its ends, and the brush being fixed to the wand at the other end; the brush comprising twisted metal fixing a plurality of bristles.

Regarding such a brush, many types of brushes are known. For example, the following French patents describe brushes: FR-A-2 505 633, FR-A-2 605 505, FR-A-2 607 372, FR-A-2 607 373, FR-A-2 627 068, FR-A-2 627 363, FR-A-2 637 471, FR-A-2 637 472, FR-A-2 650 162, FR-A-2 663 826, FR-A-2 668 905, FR-A-2 675 355, FR-A-2 685 859, FR-A-2 690 318, FR-A-2 701 198, FR-A-2 706 749, FR-A-2 715 038, FR-A-2 745 481, FR-A-2 748 913, FR-A-2 749 489, FR-A-2 749 490, FR-A-2 753 614, FR-A-2 755 693, FR-A-2 774 269, FR-A-2 796 531, FR-A-2 796 532, FR-A-2 800 586. The following United States patents also describe brushes: U.S. Pat. Nos. 4,733,425, 4,861,179, 5,357,987, 5,595,198, 6,241, 411, 6,427,700.

Constant changes in mascara formulations require development of novel brushes to allow application of such formulations, typically in a form suitable for each new formulation.

Further, users also need to have access to a wide range of brushes to obtain different effects, for example different levels of loading of the brush with product to be applied and/or different eyelash combing effects.

Finally, in the field of cosmetic products, there is a constant demand for novel products, in particular to personalize them with respect to formulations, applicators or packaging in general, since reinventing products has become an absolute commercial necessity in order to retain market share.

BRIEF SUMMARY OF THE INVENTION

According to embodiments of the invention, a mascara brush comprises a core having an axis formed from a helical twist formed by two twisted strands of a metal wire folded upon itself, and a plurality of bristles fixed to the core between the twisted strands over a portion extending over an axial length L of the helical twist and comprising a succession of n turns. The plurality of bristles comprise a first plurality of bristles termed radial bristles extending radially with respect to the core. The core, with a length $L_0$>L, has a lower end typically formed by a hairpin fold straddling the metal wire and an upper portion, typically with a length $L_0$-L, for fixing to a wand of a mascara applicator. The plurality of bristles comprises, in addition to the first plurality of bristles termed radial bristles, at least one second plurality of bristles termed axial bristles since they extend parallel to the axial direction.

The characteristic elements of the brushes may be introduced or applied to the majority of known brushes. Regardless of the type of the first plurality of bristles, when applying makeup, the eyelashes are not simply combed along an axis constituted by two parallel fibers or bristles, but along two parallel fibers or bristles and a fiber or bristle perpendicular to the preceding two. This results in an enhanced volume effect, which is particularly advantageous.

Embodiments of the invention allow the manufacture of a new generation of brushes different from conventional brushes in that, compared with a conventional brush formed from only radial bristles, the brushes in accordance with embodiments of the invention form a three-dimensional network by interlacing radial and axial bristles, which simultaneously modifies the flexibility of the radial bristles, contact of the eyelashes with the brush, loading with mascara, etc. The usual types of fibers may be used, so that it is possible to obtain a wide variety of brushes from existing fibers.

The brushes can broaden the range of special effects that users can obtain when applying makeup to the eyes. The brushes also can broaden the range of possible mascara formulations, in particular to allow the possibility of using a mascara that is more fluid than traditional mascaras. Finally, the brushes may be manufactured cheaply using methods in accordance with embodiments of the invention, the methods being employed with minimum adaptation or transformation of traditional brush manufacturing machinery.

BRIEF DESCRIPTION OF FIGURES

FIG. 4*a* is a diagrammatic sectional view of a device (7) comprising a means (70) for rotating in an axial direction (10) the blank of FIG. 3*b*. The curved arrows represent the means for rotating the blank (1") and the tube.

FIG. 4*b* is a perspective view of the blank (1'") obtained after the long fibers have been folded into the short fibers, at the end of the step shown in FIG. 4*a*, to form the second plurality of axial bristles.

FIG. 4*c* is a perspective view of the blank of FIG. 4*b* after application of a binding to the top end of the axial bundle forming the second plurality of axial bristles.

DETAILED DESCRIPTION

Figure 1A:
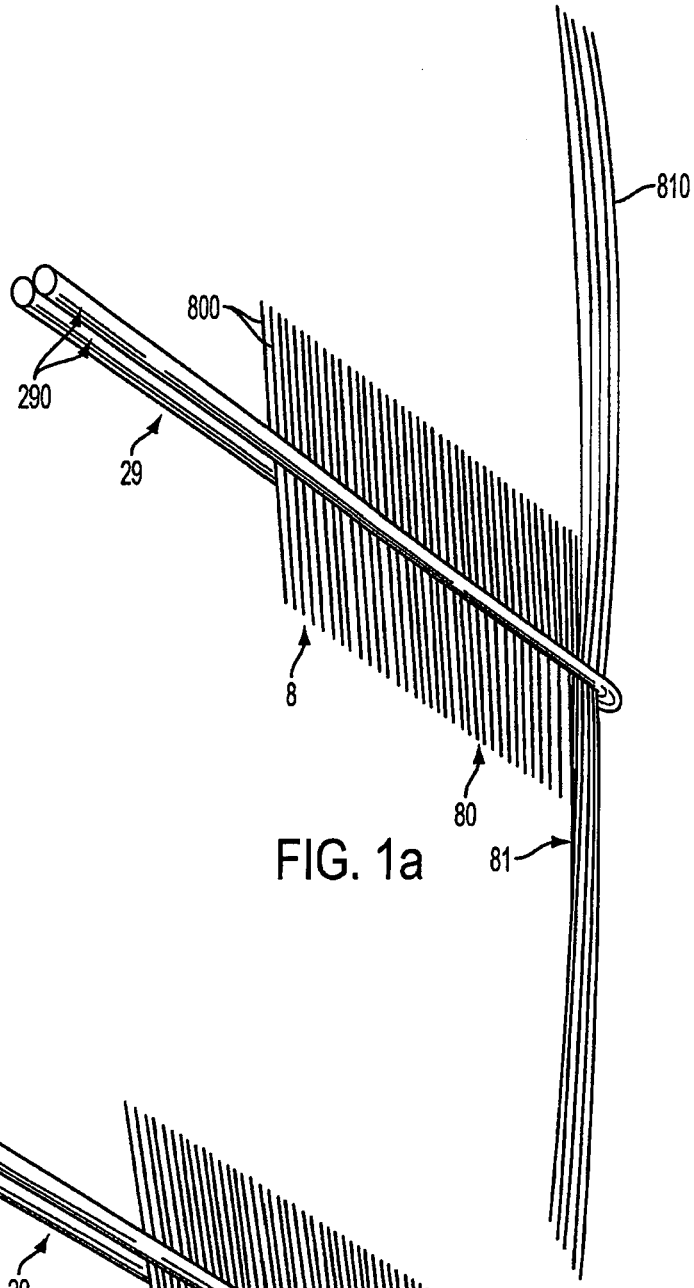
FIGS. 1*a* to 1*b* illustrate an initial step in the methods for manufacturing brushes.
Figure 1B:
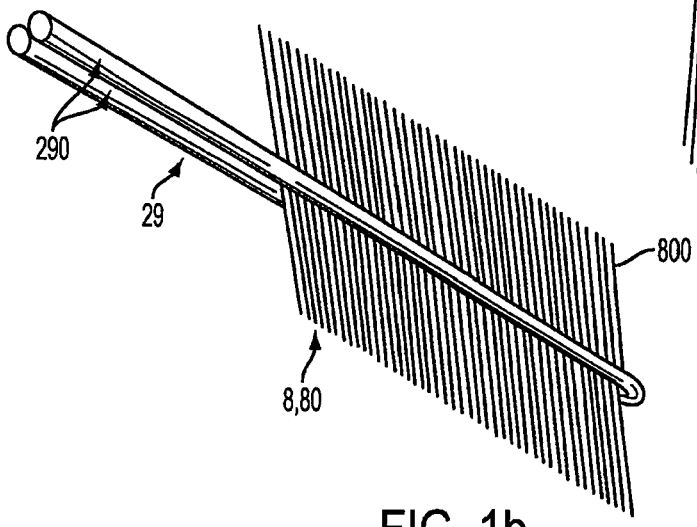

FIGS. 1*a* and 1*b* show a metal pin (29) formed by folding a portion of a metal wire on itself to produce two metal strands (290) of the pin, typically parallel, with a lap of fibers (8) introduced into the pin. In FIG. 1*a*, the lap (8) comprises a first lap (80) of fibers termed short fibers (800) to form the first plurality (3) of radial bristles, and a second lap (81) of fibers termed long fibers (810) to form the second plurality (4) of axial bristles.

Figure 3A:
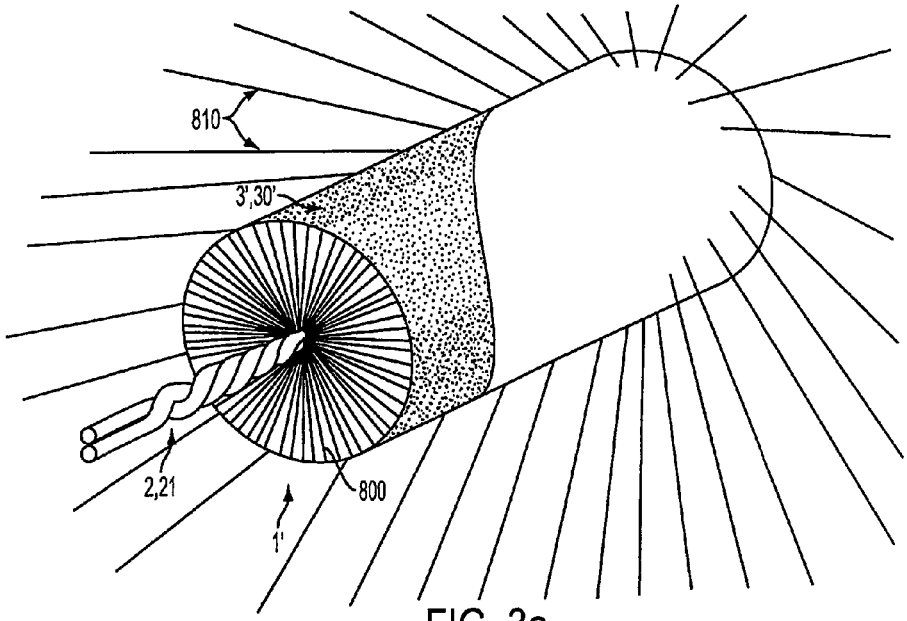
FIG. 3*a* shows the brush blank obtained after twisting the metal pin of FIG. 1*a*.
Figure 3B:
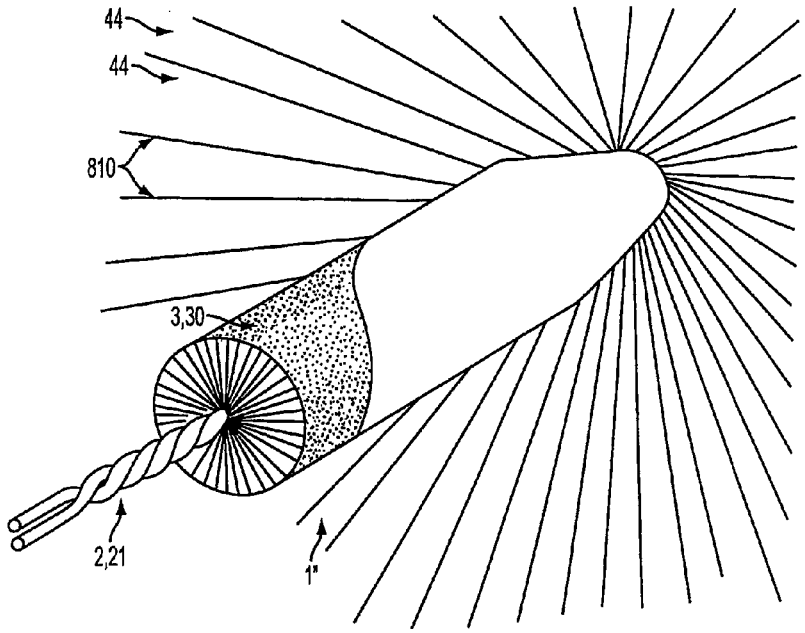
FIG. 3*b* shows the blank (1") obtained after trimming the first plurality of short fibers.

As shown in FIG. 3*a*, the brush blank is obtained after twisting the metal pin in FIG. 1*a*. The blank is shown in rotation, the long fibers forming a corona that is perpendicular to the axial direction, while the short fibers form a plurality (3') of axial bristles (30') before trimming. The blank of FIG. 3*b* is obtained by trimming or trimming and shaping to a desired length the first plurality of short fibers. The bristles may be trimmed, for example, with a cutting tool, and shaped to the dimensions required to provide a plurality of axial bristles. The blank (1") is shown in rotation, the long fibers forming a corona which is perpendicular to the axial direction.

Figure 2A:
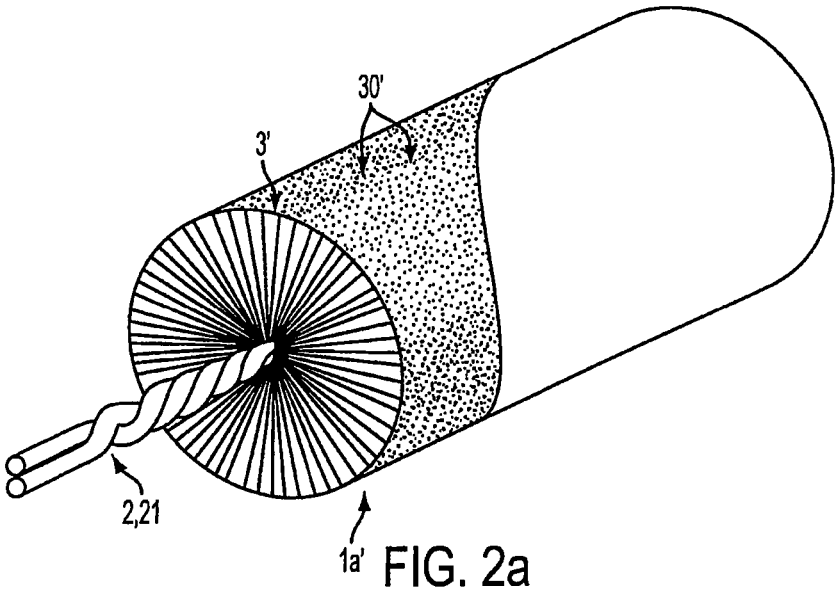
FIG. 2*a* is a partial perspective view showing the brush blank (1*a*') obtained after twisting the metal pin of FIG. 1*b*.
Figure 2B:
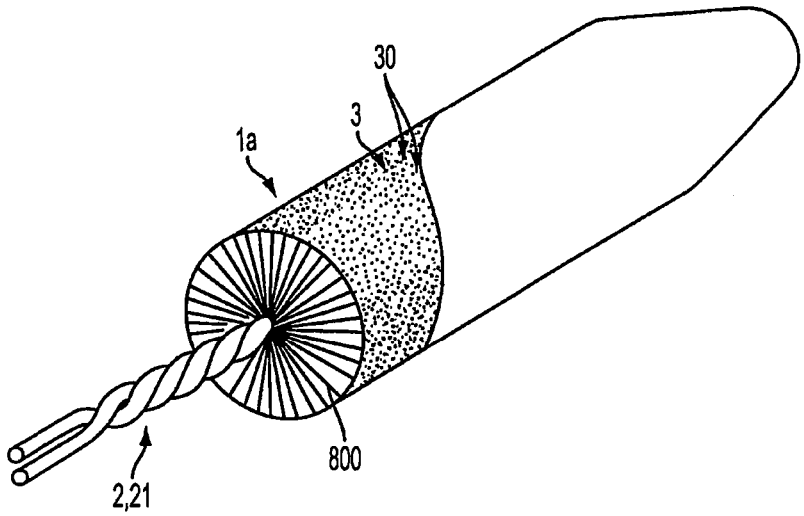
FIG. 2*b* is a partial perspective view showing the brush (1*a*) obtained after trimming the blank (1*a*') of FIG. 2*a*.

In comparison, as shown in FIG. 1*b*, the lap (8) comprises only one lap (80) of fibers termed short fibers (800) intended to form a plurality of radial bristles, using a conventional manufacturing method. As shown in FIG. 2*a*, the brush blank (1*a*') obtained after twisting the metal pin with bristles (FIG. 1*b*) comprises a core and a plurality (3') of axial bristles (30') before trimming the axial bristles to length. A brush (1*a*) of desired dimensions is obtained by trimming or shaping and trimming the axial bristles (30') to form a plurality of axial bristles (30) as shown in FIG. 2*b*.

Figure 4A:
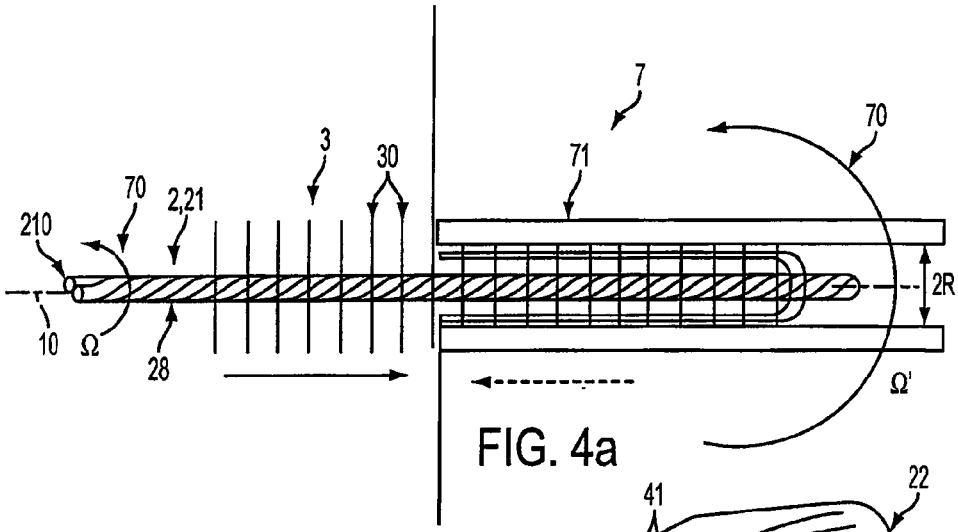
FIGS. 4*a* to 4*c* show a method for manufacturing the brush of FIG. 6*a*.
Figure 4B:
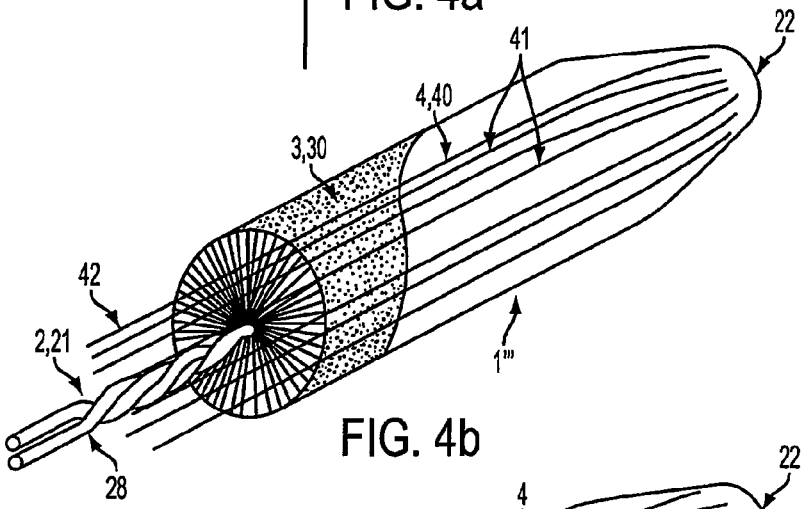

With reference to FIG. 4*a*, a device (70) such as a lathe for rotating the blank (1") rotates it at a speed Ω. The blank (1") can be introduced into a tube (71) of diameter 2R, rotating at a rate Ω' typically equal to Ω. As shown in FIG. 4*a*, about 50% of the length L of the blank (1") has been introduced into the tube.

As shown in FIGS. 4*b*, 4*c*, 5 and 6*a* to 7*f*, the second plurality of bristles may penetrate into all or part of the first plurality of bristles, to interlace radial bristles and axial bristles, typically at right angles. By interlacing with the radial bristles (30), the axial bristles (41) considerably modify both lifting of mascara and its application to the eyelashes, the lashes separating the radial bristles and bearing against the axial bristles when applying mascara with the brush (1).

As shown in FIGS. 6*a*-6*f*, the brush blanks (1''') may have different configurations of long and short fibers, along a portion (26) of the core (2), with the long fibers forming an axial bundle of axial bristles. These brush blanks (1''') correspond to an intermediate state in which the top (42) or bottom (43) ends of the axial bundle (40) are free of connection means (6).

Figure 6A:
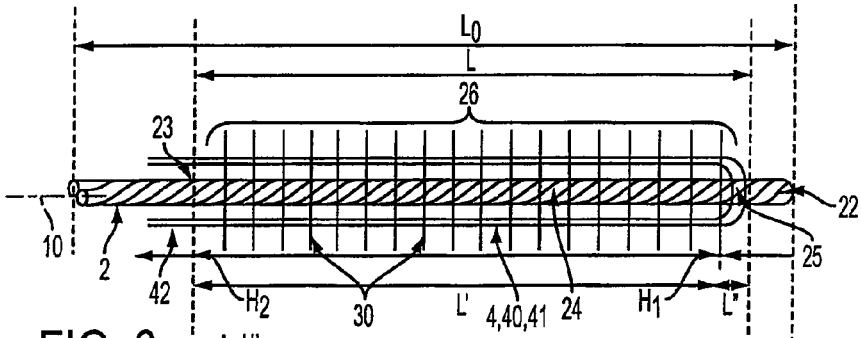
FIGS. 6*a* to 6*f* are diagrammatic views in axial cross section, of brush blanks (1'") to show different configurations of long and short fibers.

The core (2) is shown with the lower end (22) of the twist of the core on the right and the upper end (23) on the left, the end of the twisted metal strands comprising the upper end intended to be fixed to an applicator wand. The lower end (22) is shown longer than actual size. The first plurality of radial short bristles (3) is diagrammatically shown by a plurality of vertical lines while the second plurality of axial long bristles (4) is shown by four horizontal lines, two portions of long fibers forming four axial bristles (41). In FIGS. 6*a*, 6*c* and 6*d*, the long fibers have been folded over to the left, while in FIGS. 6*b*, 6*e* and 6*f*, the long fibers have been folded over to the right, i.e. towards the lower end (22) of the core.

In FIG. 6*a*, the second plurality of long fibers (4) is fixed to the second axial zone (25) of the core (2), towards the lower end (22) of the core(2). The first plurality of short fibers (3) is fixed to the first axial zone (24) of the core (2). The positioning of the laps of fibers (8, 80, 81) of FIG. 1*a* corresponds to the brush configuration shown in FIG. 6*a*.

Figure 6B:
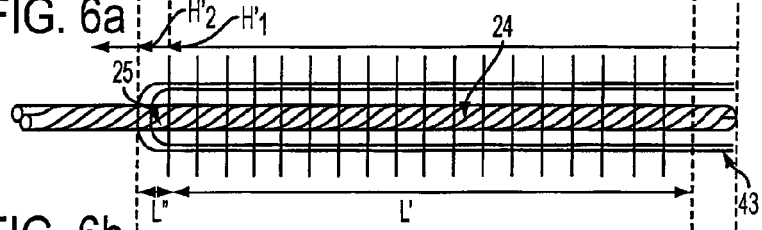
Figure 6C:
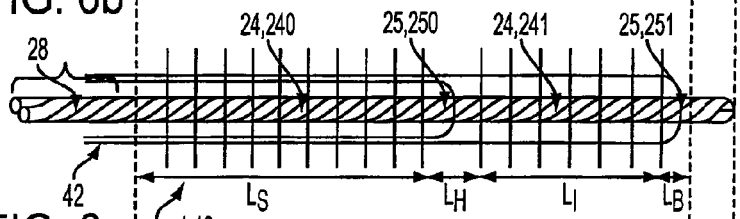
Figure 6D:
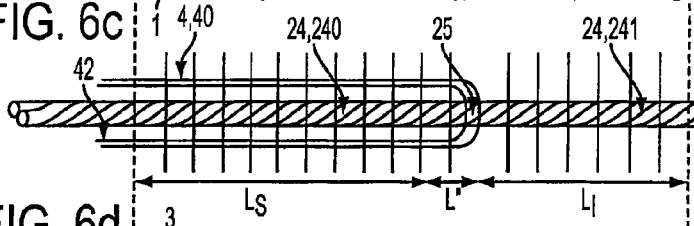

In FIG. 6*b*, the second plurality of long fibers is fixed to the second axial zone (25) of the core (2), towards the upper end (23) of the core (2).

In FIG. 6*c*, similar to FIG. 6*a*, the second axial zone (25) of the core (2) comprises two portions: a portion termed the top portion (250) located in a median portion (27) of the core, and a portion termed the bottom portion (251) located towards the lower end (22) of the core (2). Similarly, the first axial zone (24) comprises two portions: a portion termed the upper portion (240) and a portion termed the lower portion (241).

In FIG. 6*d*, the axial zone of the core (2) corresponds to a median portion (27) of the core, the first axial zone (24) comprising two portions either side of the median portion (27): the upper portion (240) and the lower portion (241).

Figure 6E:
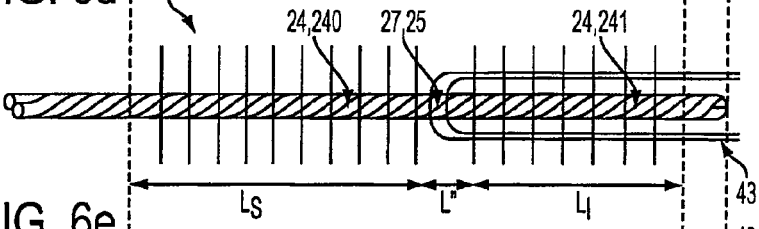

FIG. 6*e* is similar to FIG. 6*d*, but with the plurality of long fibers oriented to the right towards the lower end (22) instead of being orientated towards the left as in FIG. 6*d*.

Figure 6F:
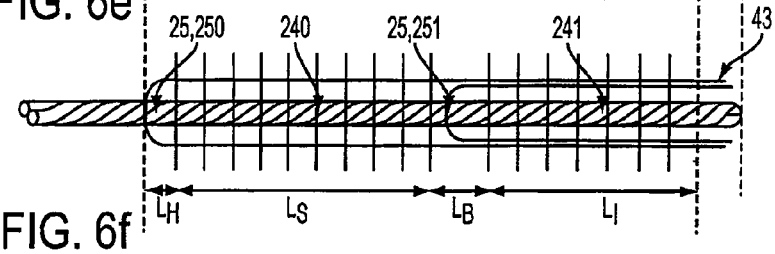

In FIG. 6*f*, similar to FIGS. 6*b* and 6*d*, the second axial zone (25) of the core (2) comprises two portions: the top portion (250) located at the upper end (23) of the portion (26) of the core carrying the pluralities of short fibers or radial bristles (30), and the bottom portion (251) located in a median portion (27) of the core. Similarly, the first axial zone (24) comprises two portions: the upper portion (240) introduced between the top and bottom portions and the lower portion (241), all of the portions (240, 241, 250, 251) being juxtaposed.

As shown in FIGS. 6*a* and 6*b*, the first plurality of radial bristles may be fixed to the core over an axial length L'<L of the twist, and the second plurality of axial bristles may be fixed to the core over an axial length L"<L.

As shown in FIG. 6*a*, the axial lengths L' and L" may be such that L'+L"=L, the first plurality of radial bristles and the second plurality of axial bristles being respectively fixed to a first and a second axial zone of the core, the first axial zone and second axial zone being distinct and typically adjoining. As also shown in FIG. 6*a*, the second axial zone may extend over a height $H_1$ and the first axial zone may extend from the height $H_1$, typically equal to L", to the height $H_2>H_1$, typically equal to L, the heights $H_1$ and $H_2$ being ordinates or axial distances taking the lower end as the origin, the second axial zone typically adjoining the lower end of the core.

As shown in FIG. 6*b*, the first axial zone may extend over a height $H'_1$, typically equal to L', the second axial zone may extend from the height $H'_1$ to a height $H'_2>H'_1$, typically equal to L, the heights $H'_1$ and $H'_2$ being ordinates or axial distances taking the lower end as the origin, the first axial zone typically adjoining the lower end of the core.

As shown in FIG. 6*d*, the second axial zone may be positioned between two portions of the first axial zone, between a portion termed the upper portion with length $L_S$ and a portion termed the lower portion with length $L_1'$. The first axial zone may thus comprise two portions, a portion termed the upper portion with length $L_S$ and a portion termed the lower portion with length $L_1$, where $L'=L_S+L_1$, as shown in FIGS. 6*d* and 6*e*.

As shown in FIGS. 6*c* and 6*f*, the second axial zone may comprise at least two pluralities of axial bristles, forming two distinct portions, a portion termed the top portion with length $L_H$ and a portion termed the bottom portion with length $L_B$, where $L''=L_H+L_B$.

In one embodiment of the brush as shown in FIGS. 6*a*, 6*c* and 6*d*:

(a) all or part of the first axial zone may adjoin the upper portion;

(b) said second plurality of axial bristles may be orientated towards the upper portion, the second plurality of axial bristles having an axial length sufficient to axially traverse the first axial zone and so that the second plurality of axial bristles forms an axial bundle having an end termed the top end reaching the upper portion;

(c) a connection means may fix the upper end of the axial bundle typically to the upper portion (28), so that the second plurality of axial bristles cannot separate from the core particularly during use of the brush.

In a further embodiment of the brush as shown in FIGS. 6*b*, 6*e* and 6*f*:

(a) all or part of the first axial zone may adjoin the upper portion;

(b) said second plurality of axial bristles may be orientated towards the lower end, the second plurality of axial bristles having an axial length sufficient to axially traverse the first axial zone and so that the second plurality of axial bristles forms an axial bundle having an end termed the bottom end at the lower end or below the lower end;

(c) a connection means may fix the bottom end of the axial bundle typically at the lower end or below the lower end, so that the second plurality of axial bristles cannot separate from the lower end or from the axis particularly during use of the brush.

Figure 7A:
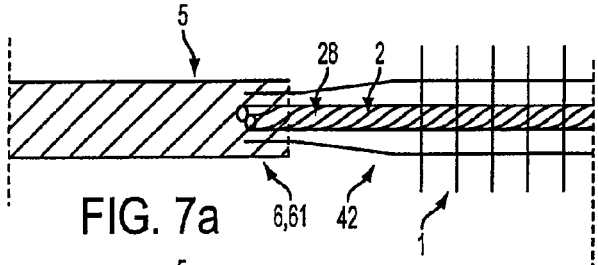
FIGS. 7*a* to 7*f* show axial cross sections of different means for connecting the end of the bundle of long fibers, the end being a top end in FIGS. 7*a* to 7*c*, and a bottom end in FIGS. 7*d* to 7*f*.
Figure 7B:
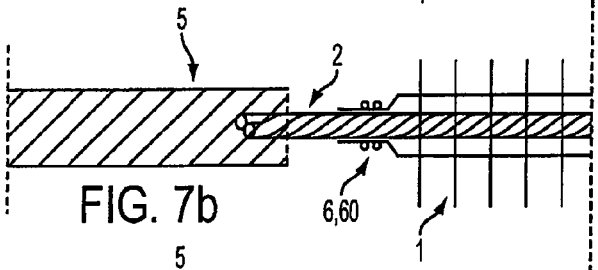
Figure 7C:
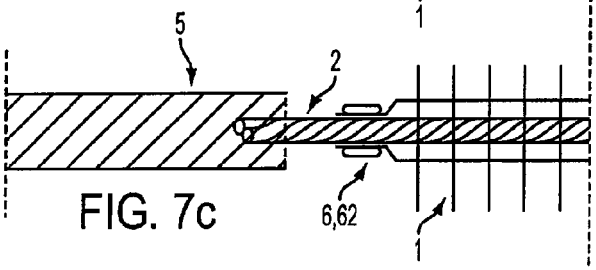
Figure 7D:
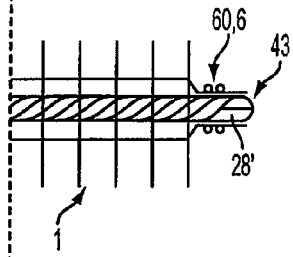
Figure 7E:
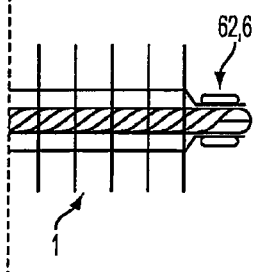
Figure 7F:
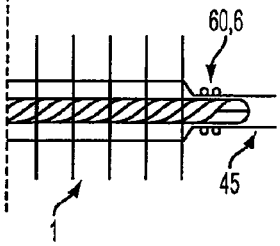

As shown in FIGS. 4*c* and 7*a* to 7*f*, the connection means may comprise bonding, a binding or a fixing ring or clip surrounding and binding the bundle at its end. The connection means also may comprise soldering the end or self-sealing the end. The end may form a corona (44) of axial bristles, the ends of the bristles being rendered integral and soldered to each other by localized heating to form the connection means. As shown in FIGS. 4*c* and 7*a* to 7*c*, the connection means may ensure fixing of the top end of the axial bundle to the upper portion or to the wand. However, as shown in FIGS. 7*d* to 7*f*, the connection means may fix the bottom end of the axial bundle to a lower portion (28') of the core which is free of bristles.

In FIG. 7*a*, the connection means (6) is a molding (61) over the wand (5) of the applicator. In FIGS. 7*b*, 7*d* and 7*f*, the connection means (6) is a binding (60). In FIGS. 7*c* and 7*e*, the connection means (6) is a fixing ring (62).

As shown in FIG. 7*f*, with long fibers of a sufficient length, it is possible to form a small paintbrush (45) at the lower end of the brush.

According to aspects of the invention, the total number of turns n of the portion of the core carrying the pluralities of bristles may be from 10 to 24, the number of turns n' corresponding to the first plurality of bristles, and the number of turns n" corresponding to the second plurality of bristles being such that n=n'+n" and that n'/n"=L'/L".

According to aspects of the invention, the ratio L'/L" may be from 0.5 to 30, or from 5 to 20, and L may be from 3 mm to 50 mm.

The first plurality of bristles may be formed by radial bristles, typically formed from a polymeric plastics material, the number N' per turn being 5 to 80, with a radial length 1' of 2 mm to 20 mm, and with a diameter which is typically from 0.05 mm (2 mils) to 0.375 mm (15 mils). The plurality of bristles may be formed by bristles which are identical or different as regards their diameter, cross section, chemical nature or mechanical characteristics.

The second plurality of bristles may be formed by axial bristles, the number N" being 4 to 100, with an axial length 1" of 5 mm to 60 mm, and with a diameter of 0.05 mm to 0.375 mm.

In accordance with one embodiment of the invention, the second plurality of bristles may include or be replaced by metal wires. In this case, the metal wires, taken alone or in groups of several wires, may carry a plurality of beads with a typical diameter of less than 1 mm. The second plurality of wires may form a cylindrical axial bundle or a helical bundle.

As will be seen below with respect to the manufacturing method, the method used is the same for producing a cylindrical axial bundle or a helical bundle, and there is no particular difficulty in obtaining one or the other of these embodiments.

In a further aspect, a method for manufacturing a mascara brush is provided. In the method:

(a) a metal pin (29) is formed by folding a portion of metal wire upon itself to produce two metal strands (290) of the pin, typically parallel;

(b) a lap (8) of fibers is prepared;

(c) the lap (8) is introduced between the strands (290) of the pin, over an axial length L, so that typically, the pin forms a mediator for the lap of fibers;

(d) the pin is then twisted to form a brush blank (1', 1", 1"') comprising the core (2) forming the helical twist (21) fixing the lap of fibers between twisted strands (210) by n turns over the length L, and a plurality (3') of radial bristles (30');

(e) all or part of the plurality (3') of radial bristles (30'), after rotating the brush blank around the axis, is trimmed, generally using a trimming tool, to trim all or part of the fibers to the desired radial length and to obtain the brush (1) comprising a plurality of radial bristles (30).

The method is characterized in that:

(1) in the step b), the lap of fibers comprises at least one first lap of fibers termed short fibers intended to form the first plurality of bristles, and a second lap of fibers termed long fibers intended to form the second plurality of bristles;

(2) the method may comprise a complementary step of orientating the plurality of long fibers of the second lap in the axial direction to form the axial bundle;

(3) the complementary step may be followed by a fixing step in which a connection means is applied to the end of the axial bundle to form the brush and so that the long fibers cannot separate from the axis during use of the brush.

The complementary step, which is carried out after step d) for forming the twist, may be carried out either before or after step e) when the latter is carried out, which is usually the case. In the complementary step of the method:

the blank may be rotated about the axis, typically using a lathe, at a rotation rate Ω sufficient so that the second plurality of long fibers which is subjected to the centrifugal force resulting from the rotation extends perpendicular to the axis and typically forms a corona perpendicular to the axis a tube with an internal radius R, disposed along the axis, may be rotated at a rate of rotation Ω' that is typically equal to the rate of rotation Ω of the blank;

then the blank may be introduced into the tube to fold over the corona of long fibers in the axial direction, and to obtain the axial bundle, the axial bundle comprising or forming the second plurality of fibers disposed at a distance R from the axial direction, with R typically being from 1 mm to 4 mm.

To obtain a cylindrical axial bundle, it is sufficient for Ω' to be equal to Ω. To obtain a helical bundle, it is sufficient for Ω' to be slightly different from Ω. Depending on whether Ω'>Ω or Ω'<Ω, a helix which turns in one direction or the other (right or left handed) is obtained.

It is possible and advantageous to exploit the rotation of the blank to simultaneously carry out step e) of the method. In effect, with the blank being rotated and the long fibers forming the corona, a trimming tool may be brought near to the plurality of radial bristles to simultaneously carry out step e) of the method.

Figure 4C:
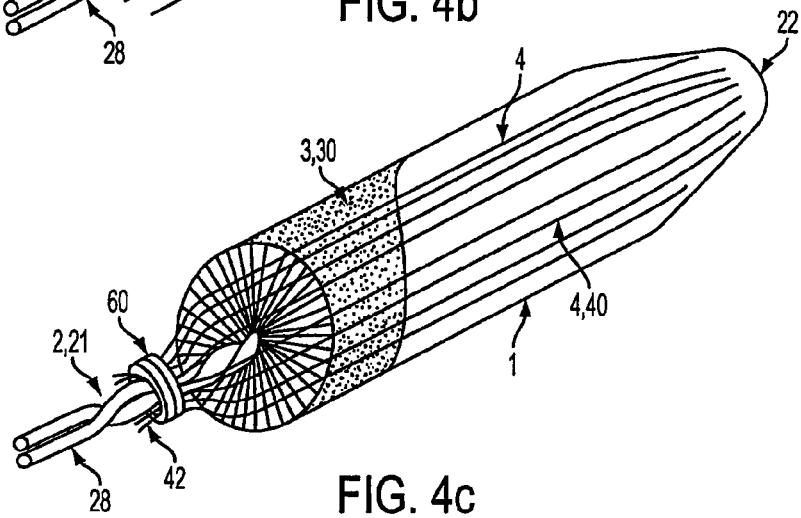
Figure 5:
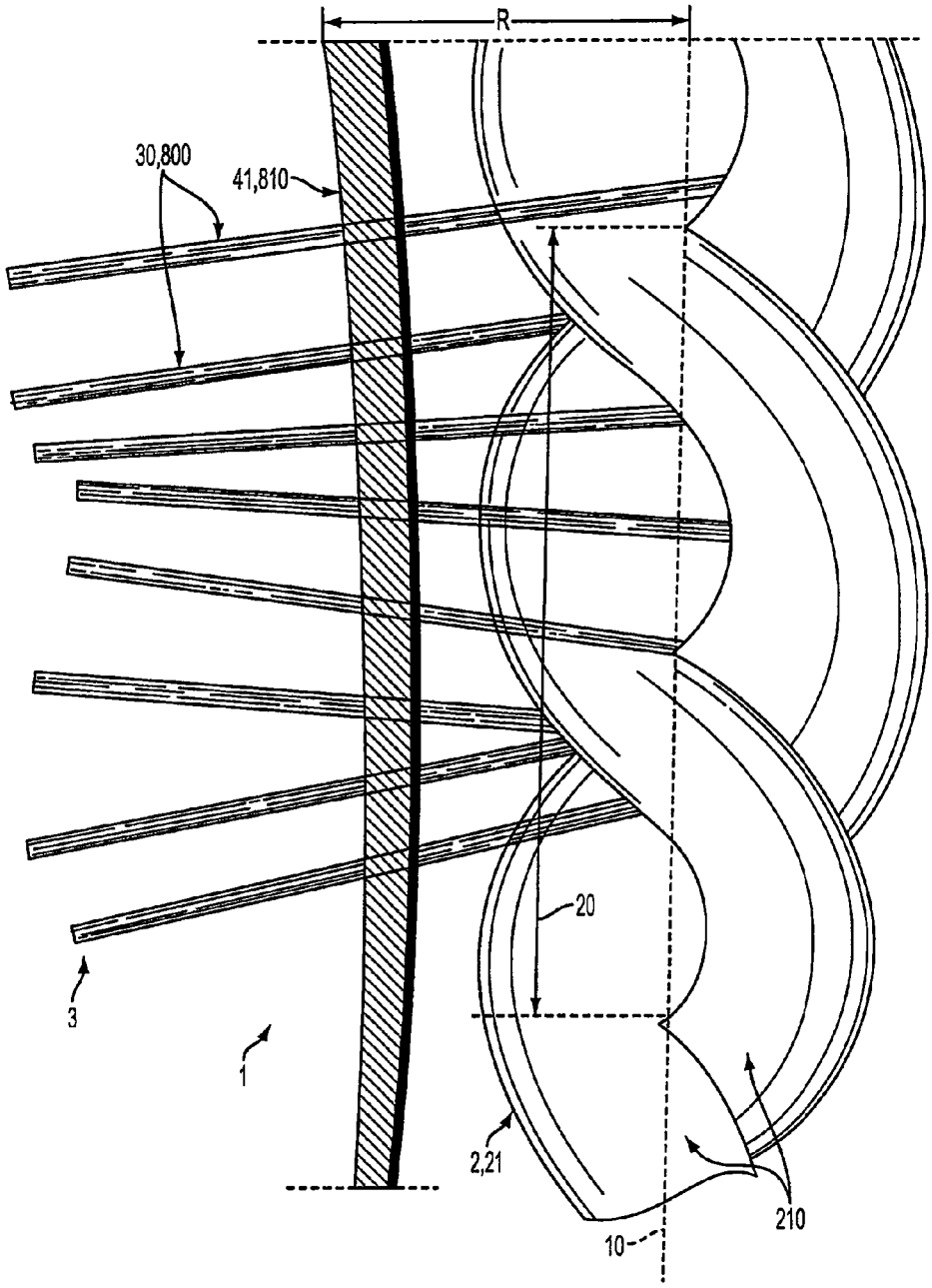
FIG. 5 is a partial enlarged view of a portion of the brush illustrating the interlacing of radial bristles and an axial bristle, typically at right angles, the axial bristle being parallel to the axial direction and to the core.

As shown in FIGS. 4*c*, 7*b* and 7*f*, the fixing step may comprise forming a binding at the end of the bundle of long fibers forming the second plurality of bristles.

As shown in FIG. 7*a*, the fixing step may be carried out during fixing of the upper portion of the brush to the applicator wand, typically by molding the wand over the upper portion which is flush with the end of the bundle of long fibers forming the second plurality of bristles has been plated.

As shown in FIG. 1*a*, the first lap of short fibers and the second lap of fibers termed long fibers may be disposed side by side in the pin.

EXAMPLES

A variety of commercially available fibers and mixtures thereof, were used to manufacture brushes. In particular, polyamide fibers with a diameter of about 0.075 mm (3 mils), about 0.15 mm (6 mils), about 0.22 mm (9 mils) and about 0.3 mm (12 mils) were used. Brushes were manufactured in which short fibers with diameter D1 and long fibers with diameter D2 were used, with D2>D1, and typically with D2 in the range 1.5*D1 to 5*D1.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention and described and claimed herein.

What is claimed is:

1. A mascara brush comprising a core having an axis and a length $L_0$, wherein the core comprises a single metal wire, the metal wire being folded upon itself to form a hairpin fold having two strands, the two strands being helically twisted together to form twisted strands, the twisted strands having an axial length L and a succession of n turns, and a plurality of bristles fixed to the core between the twisted strands over the axial length L, the plurality of bristles comprising a first plurality of radial bristles extending radially with respect to the core, wherein the core has a lower end formed by the hairpin fold and an upper portion, for fixing to a wand of a mascara applicator, and wherein the length $L_0$>L, wherein the plurality of bristles comprises at least one second plurality of axial bristles extending parallel to the axis and penetrating into at least part of the first plurality of radial bristles to interlace the radial bristles and axial bristles.

2. A brush according to claim 1, wherein the interlacing of radial bristles and axial bristles is at right angles.

3. A brush according to claim 1, wherein the first plurality of radial bristles is fixed to the core over an axial length L'<L of the twist, and in which the second plurality of axial bristles is fixed to the core over an axial length L"<L.

4. A brush according to claim 3, wherein the axial lengths L' and L" are such that L'+L"=L, the first plurality of radial bristles and the second plurality of axial bristles being respectively fixed to a first and a second axial zone of the core, the first axial zone and second axial zone being distinct and adjoining.

5. A brush according to claim 4, wherein the second axial zone extends over a height $H_1$ and the first axial zone extends from the height $H_1$ to the height $H_2$>$H_1$, the heights $H_1$ and $H_2$ being ordinates or axial distances taking the lower end as the origin, the second axial zone adjoining the lower end of the core.

6. A brush according to claim 3, wherein the total number of turns n of the portion of the core carrying the pluralities of bristles is from 10 to 24, the number of turns n' corresponding to the first plurality of bristles and the number of turns n" corresponding to the second plurality of bristles being such that n=n'+n" and that n'/n"=L'/L".

7. A brush according to claim 3, wherein the ratio L'/L" is from 0.5 to 30, and to which L is from 3 mm to 50 mm.

8. A brush according to claim 1, wherein a connection means fixes an end of the axial bristles to the core, the connection means comprising bonding, a binding or a fixing ring or clip surrounding and binding the bundle at its end.

9. A brush according to claim 8, wherein the axial bundle has a top end and the connection means fixes the top end of the axial bundle to the upper portion or to the wand.

10. A brush according to claim 1, wherein the first plurality of bristles is formed by radial bristles, the number N' per turn being between 5 to 80, with a radial length l' of 2 mm to 20 mm, and with a diameter from 0.05 mm (2 mils) to 0.375 mm (15 mils).

11. A brush according to claim 1, wherein the second plurality of bristles is formed by axial bristles, the number N" being between 4 to 100, with an axial length l" of 5 mm to 60 mm, and with a diameter of 0.05 mm to 0.375 mm.

12. A brush according to claim 11, wherein the second plurality of bristles comprises metal wires.

13. A brush according to claim 1, wherein the second plurality of bristles forms a cylindrical axial bundle or a helical bundle.

14. A brush according to claim 1, wherein the axial bristles are folded along the length of the core, and wherein free ends of the axial brushes are fixed to the core.

* * * * *